United States Patent [19]

Haunschild

[11] 4,417,974

[45] Nov. 29, 1983

[54] RISER CRACKING OF CATALYST-DEACTIVATING FEEDS

[75] Inventor: Willard M. Haunschild, Walnut Creek, Calif.

[73] Assignee: Chevron Research Company, San Francisco, Calif.

[21] Appl. No.: 410,206

[22] Filed: Aug. 23, 1982

[51] Int. Cl.[3] ..... C10G 11/18

[52] U.S. Cl. ..... 208/75; 208/72; 208/74; 208/78; 208/113; 208/121; 208/164; 502/55

[58] Field of Search ..... 208/75, 78, 113

[56] References Cited

U.S. PATENT DOCUMENTS

| | | | |
|---|---|---|---|
| 2,938,856 | 5/1960 | Hettick | 208/74 |
| 3,008,896 | 1/1961 | Lawson | 208/150 |
| 3,182,011 | 5/1965 | Friedman | 208/78 |
| 3,849,291 | 11/1974 | Owen | 208/78 |
| 3,856,659 | 12/1974 | Owen | 208/151 X |
| 3,970,587 | 7/1976 | Shinnar et al. | 208/164 X |
| 3,997,428 | 12/1976 | McKenna | 208/78 |
| 4,090,948 | 5/1978 | Schwarzenbek | 208/74 |
| 4,234,411 | 11/1980 | Thompson | 208/74 |
| 4,257,875 | 3/1981 | Lengemann et al. | 208/75 X |
| 4,374,019 | 2/1983 | Hettinger et al. | 208/164 X |

OTHER PUBLICATIONS

Shankland & Schmitkons "Determination of Activity and Selectivity of Cracking Catalyst" Proc. API 27 (III) 1947 pp. 57–77.

*Primary Examiner*—Patrick Garvin
*Assistant Examiner*—George Schmitkons
*Attorney, Agent, or Firm*—D. A. Newell; S. R. La Paglia; W. D. Reese

[57] ABSTRACT

Conversion of a hydrocarbon feed containing a catalyst-deactivating component in a riser FCC cracking system can be increased by employing a baffle in the lower part of the riser to exclude a portion of the upwardly flowing catalyst from initial contact with feed hydrocarbons containing the catalyst-deactivating component. Part of the catalyst flowing upwardly through the riser thereby is excluded from contact with the catalyst-deactivating component until the catalyst-deactivating component has been at least partially removed from the resulting hydrocarbonaceous vapor by deposition on another portion of the upwardly flowing catalyst.

3 Claims, 1 Drawing Figure

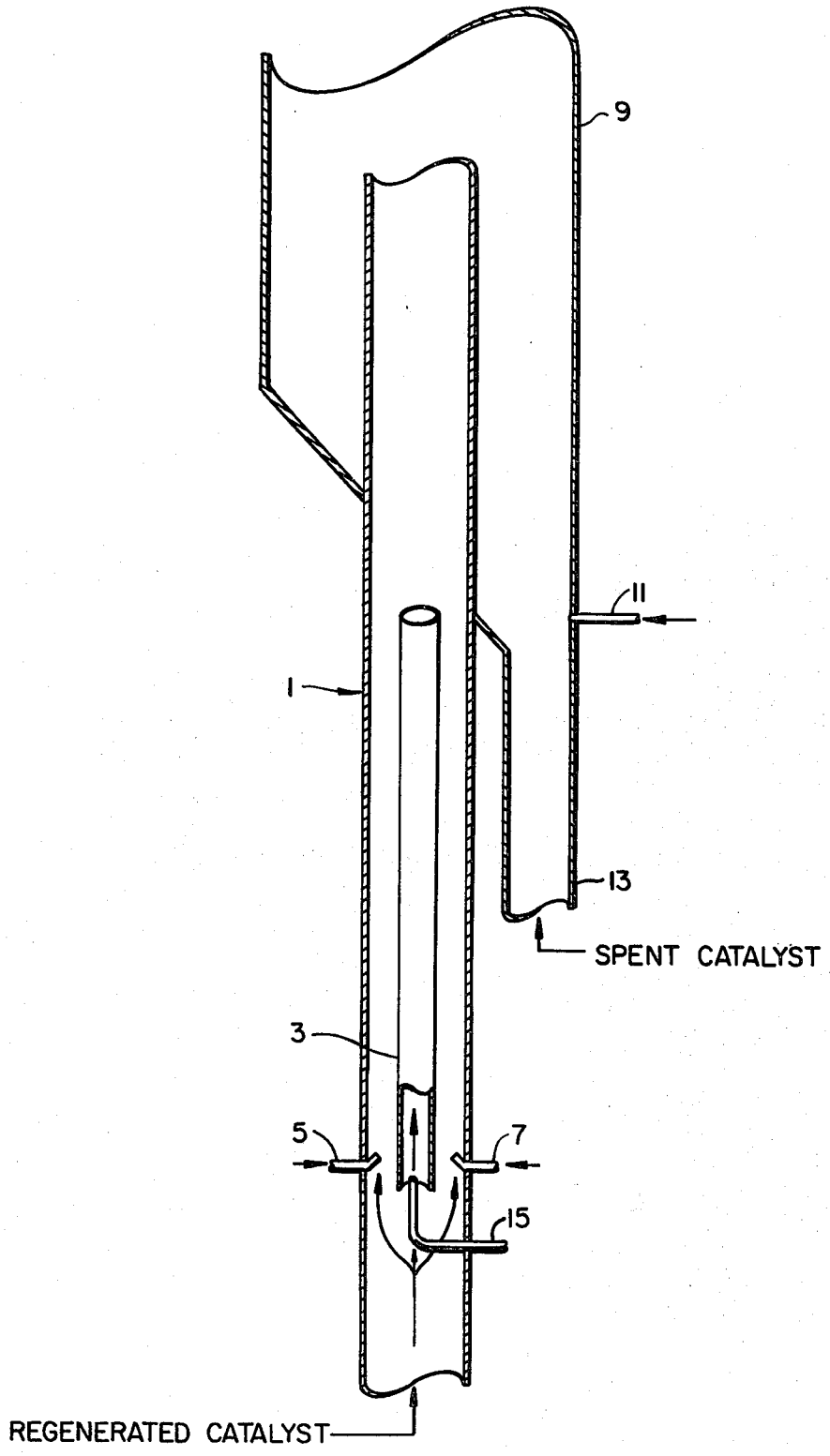
9
11
1
13
SPENT CATALYST
3
5
7
15
REGENERATED CATALYST

RISER CRACKING OF CATALYST-DEACTIVATING FEEDS

BACKGROUND OF THE INVENTION

This invention concerns catalytic cracking of hydrocarbons. In particular, the present invention concerns an improved process for catalytically cracking hydrocarbon feeds which contain catalyst-deactivating components such as asphaltenic coke precursors and nitrogen compounds.

In present commercial processes for catalytically cracking hydrocarbons in the absence of externally supplied hydrogen, the cracking catalyst is employed in the form of fine particles. The fine catalyst particles are continuously cycled between a cracking reaction zone and a catalyst regeneration zone. In the reaction zone, a stream of hydrocarbon feed is continuously contacted with fluidized catalyst particles, usually at a temperature of about 425° C. to 600° C. Reactions of hydrocarbons at the high temperatures employed cause deposition of coke on the catalyst particles. The resulting cracked hydrocarbons are thereafter separated from the spent, coke-containing catalyst, recovered and further processed by fractionation. The spent catalyst is stripped of volatiles and transferred to the catalyst regeneration zone, there catalytic activity is restored to the catalyst by burning off the coke.

The extent of hydrocarbon conversion obtained in a fluid catalytic cracking operation may be defined as the volume percent of fresh hydrocarbon feed normally boiling above the gasoline endpoint which is changed to products boiling below the gasoline endpoint. The end boiling point of gasoline for the purpose of determining conversion is conventionally defined as 221° C. The extent of conversion is often employed as a measure of the activity of a catalyst used in a commercial FCC operation. At a given set of operating conditions, a more active cracking catalyst provides greater conversion than does a relatively less active catalyst. The ability of a catalyst or a cracking reactor design to provide a greater extent of conversion for a given feedstock is desirable in that it allows an FCC system to be operated in a more flexible manner. For example, with increased conversion, feed rate to a cracking unit may be increased. The present invention provides a method for increasing feed conversion when processing feedstocks containing catalyst-deactivating components.

For the purposes of the present invention, "riser cracking" may be defined as catalytic cracking of hydrocarbons in which cracking takes place while the catalyst and hydrocarbon feed are moving cocurrently upwardly through a relatively small diameter, generally vertically elongated reaction zone, with catalyst particles being transferred through the reaction zone by entrainment in a vapor stream.

Nitrogen compounds are often present in FCC hydrocarbon feeds. Nitrogen-containing compounds are strongly adsorbed on the acidic sites in cracking catalyst during the cracking step, resulting in greatly decreased cracking activity and conversion when processing feedstocks with any appreciable nitrogen content. It has been found that a large proportion of the nitrogen compounds present in an FCC feed are deposited on the catalyst during the cracking step in a form which is not removed from the catalyst particles by steam stripping. This suggests that nitrogen compounds are preferentially strongly adsorbed on catalyst acidic sites during initial contact between the catalyst and feed.

For the purposes of the present invention, "asphaltenes" are defined as the component of a catalytic cracking feedstock which is insoluble in normal heptane and which is nondistillable (i.e., decomposes upon heating to form coke). Asphaltenes are notably present in residual fractions of petroleum distillation. Feedstocks containing asphaltenes are known to deposit coke heavily on the cracking catalyst during processing. This results in rapid loss of cracking activity.

U.S. Pat. No. 4,234,411 discloses a fluid catalytic cracking process employing a split flow of recycled, regenerated catalyst to a riser-reactor. A first portion of the catalyst is introduced into the lower part of the riser and a second portion of the catalyst is introduced into an upper portion of the riser. The relative amounts of catalyst introduced to the different levels of the riser are regulated in accordance with process operating temperatures in, respectively, a downstream reactor separator and in the riser-reactor.

U.S. Pat. No. 4,090,948 discloses a fluid catalytic cracking process using a riser-reactor in which the hydrocarbon feed is first contacted with spent catalyst in an upstream area of the riser-reactor. Regenerated catalyst is then mixed with the feed in a downstream part of the riser-reactor. The patent states that the spent catalyst has sufficient activity so that the highly reactive nitrogen and carbon residue containing hydrocarbon contaminants in the oil feed will deposit on the spent catalyst and thus minimize the deactivation of the active, regenerated catalyst used in the downstream part of the reactor for cracking of the oil feed.

SUMMARY OF THE INVENTION

The present invention concerns a method for increasing conversion in processes for cracking feeds containing catalyst-deactivating components such as nitrogen compounds and asphaltenes. The invention is embodied in a process for cracking a feed containing a catalyst-deactivating component in the absence of externally supplied hydrogen in contact with an entrained bed of particulate acidic cracking catalyst flowing through a riser-reactor zone, comprising: (a) maintaining first and second unmixed portions of the catalyst in separated entrained flow through an upstream part of the riser-reactor zone, the first portion of catalyst having sufficient heat energy to vaporize the feedstock; (b) vaporizing and partially cracking the feedstock in contact with the first portion of the catalyst and decreasing the concentration of catalyst-deactivating components in the feedstock by depositing such catalyst-deactivating components on the first portion of the catalyst in the upstream part of the riser-reactor zone; and (c) mixing the second portion of the catalyst with the resulting hydrocarbonaceous vapor, and cracking the hydrocarbonaceous vapor in a downstream part of the riser-reactor zone with the second portion of the catalyst.

In one modification of my invention, a second hydrocarbon feed essentially free of catalyst-deactivating components such as nitrogen compounds and asphaltenes is introduced into contact with the second portion of catalyst in the upstream portion of the riser-reactor, and the two resulting catalyst-feed mixtures are then combined in the downstream portion of the riser.

I have found that conversion of hydrocarbon feeds containing catalyst-deactivating components such as nitrogen compounds and asphaltenes in a riser cracking system can be increased simply and economically by employing a baffle in the lower part of the riser to exclude a portion of the upwardly flowing, regenerated catalyst from initial contact with deactivating, component-containing feed in the riser. Part of the upwardly flowing, active catalyst is excluded from contact with feeds containing catalyst-deactivating components until the catalyst-deactivating components have been removed from the feed vapor by deposition as solids on another portion of the upwardly flowing catalyst in the lower part of the riser.

BRIEF DESCRIPTION OF THE DRAWING

The attached drawing shows a schematic representation of a preferred embodiment of the present invention.

Referring to the drawing, there is shown a cylindrical riser-reactor zone 1. A cylindrical baffle 3 is axially disposed within a lower part of the riser zone 1. Hydrocarbonaceous feed containing a catalyst-deactivating component is introduced into the lower part of the riser 1 through nozzles 5 and 7. The upper end of the riser 1 terminates within a separator 9, which has a large cross-sectional area relative to the riser, in order to provide for separation of catalyst particles from hydrocarbon vapors. The catalyst is stripped of volatile components in the lower portion of the separator 9 with steam introduced through an inlet 11, and the spent catalyst is withdrawn through an outlet 13. A fluid inlet 15 is employed to introduce steam, inert gas and/or a clean hydrocarbonaceous feed into the channel within the baffle 3 to obtain approximately equal densities on both sides of baffle 3.

DETAILED DESCRIPTION OF THE INVENTION

The present invention is used in a process for cracking hydrocarbon feeds containing a catalyst-deactivating component. Conventional catalytic cracking feeds typically include hydrocarbons boiling between about 325° C. and about 600° C. These feeds may suitably be processed in a system employing the present invention, either with or without prior catalytic treatment. Particularly suitable feeds include atmospheric and vacuum residua fractions and so-called "synthetic" feeds, such as coal oils, bitumen, shale oils, and high boiling fractions thereof. Suitable feedstocks normally boil in the range from about 325° C. to 600° C. or higher and may suitably include a substantial fraction boiling above 600° C. Such relatively high boiling feeds and synthetic oils are known to contain, in many cases, large amounts of nitrogen compounds and asphaltenes. Suitable feedstocks may include recycled hydrocarbons which have already been subjected to cracking, such as light, medium and heavy cycle oils, as well as bottoms oils resulting from fractionation of the cracking process products. Optionally, feeds may have been previously treated or refined to remove sulfur, metals, and some of the nitrogen compounds and asphaltenes, as by hydrodemetallation, hydrodesulfurization, or hydrodenitrification processing.

In one modification of the present invention, one portion of the active, regenerated catalyst is contacted with a hydrocarbonaceous feed substantially free from catalyst-deactivating components. A feedstock suitable for use in this manner would have a nitrogen content of less than 0.1 weight percent and an asphaltenes content of less than 0.1 weight percent. Such clean feedstocks are typically easy-to-process distillate streams from selected crudes, having relatively low boiling ranges, e.g., 325° F. to 550° F.

The present invention is used in a process for cracking hydrocarbons with an acidic particulate catalyst. The suitable cracking catalysts preferably include an acidic, zeolitic crystalline aluminosilicate component. Acidic cracking catalysts which do not contain a zeolite may also be suitable for use in some situations either alone or, preferably in a mixture with zeolite-containing catalyst. Catalysts containing an acidic, layered, two-dimensional clay component are also suitable. Typical of cracking catalyst components which can be employed are activated and/or stabilized forms of Zeolite Y, Zeolite X, mordenite, ZSM-5, and the like, natural and synthetic clays, acid-treated and heat-treated clays, and the like catalytic materials. A preferred catalyst is a composite of about 5 to 50 weight percent of a rare earth and/or hydrogen-exchanged Zeolite Y-type crystalline aluminosilicate associated with a porous, inorganic oxide matrix, such as a treated clay or synthetic, amorphous silica-alumina cogel.

Particulate solids other than active, acidic cracking catalysts may in addition be circulated in the cracking system. For example, alumina particles may be included in the particulate solids inventory to help control sulfur oxides emissions during regeneration of the catalyst, as discussed in U.S. Pat. No. 4,071,436. Particles containing a highly active combustion-promoting metal, such as platinum, may also be mixed with the catalyst particles in order to facilitate complete combustion of carbon monoxide during regeneration of the catalyst.

According to the invention, a stream of active catalyst is passed upwardly through the lower (upstream) part of a riser-reactor zone in two separate entrained streams. Provision of two separate streams of catalyst is preferably conveniently accomplished by including within the riser-reactor baffle means for dividing the lower part of the riser-reactor into two channels to provide for the parallel flow through the riser of two streams of entrained catalyst. Conveniently, an existing riser-reactor can readily be fitted with appropriate baffle means without major mechanical modifications. Preferably, the lower part of a riser-reactor is divided into two channels to provide for separate flow of two streams of entrained catalyst by the inclusion in the lower part of the riser-reactor of a cylindrical baffle, which may be axially disposed within the riser. Thus, catalyst flowing into the riser, conventionally fluidized in a stream of steam, divides into two separate streams. Preferably, the baffle means employed thereby provides a central, axially disposed channel within the lower portion of the riser, through which a portion of entrained catalyst flows automatically when the catalyst is passed upwardly through the riser.

Further according to the invention, a hydrocarbonaceous feed containing a catalyst-deactivating component is substantially vaporized in contact with one portion of entrained catalyst in the lower part of the riser-reactor. The portion of catalyst used to initially vaporize the deactivating component-containing feed in the lower part of the riser-reactor is provided in an amount, relative to the weight of deactivating component-containing feed, sufficient to maintain a catalyst/feed weight ratio in the range from about 1 to about 10, preferably from about 2 to about 5. In any case, the heat energy in the portion of catalyst initially contacted with the deactivating component-containing feed must be sufficient to substantially vaporize the deactivating compnent-containing feed. Nitrogen compounds and coke-forming asphaltenes present in the deactivating component-containing hydrocarbonaceous feed when it initially enters the riser-reactor are at least partially preferentially adsorbed and deposited onto the initially contacted portion of the catalyst within the lower part of the riser. Adsorption of nitrogen contaminants and deposition of coke-forming asphaltenes onto this portion of catalyst results in a decrease in the concentration of nitrogen compounds and heavy, coke-forming asphaltenes in the resulting hydrocarbonaceous vapor stream reaching the upper portion of the riser. The second portion of active catalyst then mixes, in the upper portion of the riser-reactor, with the vapor-catalyst mixture resulting from vaporization of the deactivating component-containing feed. The weight ratio of this second portion of catalyst to the deactivating component-containing hydrocarbonaceous feed is maintained in the range from about 1 to about 10, preferably from about 2 to about 5. The total catalyst/oil weight ratio (including both the first and second portions of catalyst and any clean hydrocarbonaceous feed) is preferably maintained in the range from about 2 to about 10.

The equilibrium catalyst-oil temperature in the lower portion of the riser-reactor, in which the deactivating component-containing feed is in contact with one portion of the catalyst, is preferably maintained between about 400° C. and about 500° C. The equilibrium temperature within the upper portion of the riser, in which the feed is in contact with both portions of the catalyst employed, is preferably maintained between about 450° C. and about 600° C.

The contact time between the hydrocarbonaceous feed containing a catalyst-deactivating component and the portion of catalyst initially mixed with it within the upstream portion of the riser-reactor is maintained within the range from about 0.2 seconds to about 2 seconds, preferably from about 0.5 seconds to about 1.0 second. The contact time between hydrocarbonaceous vapors and the combined stream of both catalyst portions within the downstream portion of the riser-reactor is maintained within the range from about 0.2 seconds to about 2.0 seconds, preferably from about 0.5 seconds to about 1.0 second. The ranges of contact times mentioned above do not include contact between hydrocarbons and catalyst resulting from the presence of catalyst and hydrocarbon vapors in a large diameter separation zone after they emerge from the relatively narrow diameter riser. Operating pressures in the riser-reactor are not particularly critical. Conventional, slightly superatmospheric pressures (e.g., 1.5 to 3 atmospheres) are preferred.

In one modification of the process of the present invention, a second hydrocarbonaceous feedstock is initially contacted, in the lower portion of the riser-reactor, with the stream of catalyst which is excluded from contact with the first, deactivating component-containing feed. This second feedstock must be substantially free from the catalyst-deactivating components. The amount of clean hydrocarbonaceous feed utilized should be sufficient to maintain essentially the same density in both channels in the lower part of the riser-reactor. The temperature, pressure and other operating conditions may be within the same ranges used in connection with the first hydrocarbonaceous feedstock in the other channel in the lower portion of the riser-reactor.

If it is not desired to charge a second, clean feedstock to the lower portion of the riser-reactor to mix with the second portion of active catalyst, means should be provided for maintaining about the same densities in the two channels in the lower portion of the riser-reactor. This may be conveniently accomplished by introducing an essentially inert gas, such as steam or lower alkane hydrocarbon, into one of the channels along with the portion of the active catalyst which is to be excluded from contact with the deactivating component-containing feed.

The following illustrative embodiment describes a preferred embodiment of the present invention.

ILLUSTRATIVE EMBODIMENT

A riser cracking reactor like that shown in the attached drawing is employed. The deactivating component-containing hydrocarbonaceous feed is a gas oil feed having a normal boiling range of about 325° C. to about 550° C. The deactivating component-containing feed contains about 0.5 volume percent nitrogen compounds and/or about 1.0 weight percent coke-forming asphaltenes. The catalyst employed is a conventional, commercially available FCC catalyst containing stabilized Zeolite Y-type particles within a silica-alumina matrix. Active, regenerated catalyst is passed into the lower, upstream end of the riser vessel at the rate of 40 Tons per minute. The stream of catalyst separates into two portions as it is passed upwardly through the riser. A first portion of the catalyst flows upwardly through the channel formed within the cylindrical baffle 3 at the rate of 20 Tons per minute. The second portion of catalyst flows upwardly through the annular channel, provided around the baffle 3 within the riser vessel, at the rate of 20 Tons per minute. The nitrogen compound-containing and asphaltenes-containing gas oil feed is introduced into the annular channel downstream of the bottom end of the baffle and is vaporized in contact with the portion of catalyst flowing within the annular channel. Nitrogen-containing solids and coke resulting from decomposition of heat sensitive asphaltenes are deposited on the stream of catalyst flowing within the annular channel, thereby decreasing the nitrogen concentration in the resulting vapor stream and decreasing the tendency of catalyst-deactivating components in the nitrogen- and asphaltenes-containing feed to deactivate all of the catalyst. Thus, the catalyst-deactivating components contained in the feed are at least partially removed before the resulting vapor stream reaches the upper end of the baffle 3. Inert gas, such as steam, propane, butanes, or the like, is introduced into the lower end of the channel within the baffle 3 at a rate sufficient to maintain approximately equivalent densities in the two channels formed by the baffle 3. At the upper end of the baffle 3, the portion of active catalyst which has flowed through the channel within the baffle 3 mixes with the relatively clean vapor stream resulting from vaporization of the deactivating component-containing feed. The active catalyst effectively catalyzes cracking of the hydrocarbonaceous vapor. Since the vapor above the baffle 3 contains a decreased concentration of catalyst-deactivating components such as nitrogen compounds and asphaltenes, the overall conversion obtained in the sequential catalyst contacting according to the present invention is significantly greater than if the feed had contacted all of the catalyst at the feed inlet points. Moreover, the sequential contacting is provided in a practical and economical manner by inclusion of the baffle in the riser. In a modification of the foregoing, a clean hydrocarbonaceous feed, essentially free from nitrogen compounds and asphaltenes, is introduced into the channel within the baffle 3 through the conduit 15 at a rate sufficient to maintain equivalent densities in the two channels formed by the baffle 3.

The foregoing Illustrative Embodiment, describing a preferred embodiment of the invention, is not intended as a limitation on the scope of the invention. It is intended that all the modifications and variations of the described embodiment which will be readily apparent to those skilled in the art are within the scope of the invention, as defined in the appended claims.

What is claimed is:

1. In a process for cracking a hydrocarbonaceous feedstock containing a catalyst-deactivating component in the absence of externally supplied hydrogen in contact with an entrained bed of particulate acidic cracking catalyst flowing through a riser-reactor zone, the method for increasing conversion of said feedstock which comprises:

(a) maintaining first and second unmixed portions of said catalyst in separated entrained flow through an upstream part of said riser-reactor zone, said first portion having sufficient heat energy to substantially vaporize said feedstock;

(b) vaporizing and partially cracking said feedstock in contact with said first portion of said catalyst and decreasing the concentration of said catalyst-deactivating component in said vapor by depositing at least a portion of said catalyst-deactivating component on said first portion of said catalyst in said upstream part of said riser-reactor zone; and (c) mixing said second portion of said catalyst with the resulting hydrocarbonaceous vapor and cracking said hydrocarbonaceous vapor in a downstream part of said riser-reactor zone with said second portion of said catalyst.

2. A method according to claim 1 wherein said first and second portions of said catalyst are maintained unmixed in said lower portion of said riser-reactor zone by baffle means dividing said lower portion of said riser-reactor zone into two channels of parallel catalyst flow.

3. A method according to claim 1 wherein a second hydrocarbonaceous feedstock substantially free from catalyst-deactivating components is vaporized and partially cracked in contact with said second portion of said catalyst during said separated entrained flow.

* * * * *